US007955653B2

(12) United States Patent
Koike et al.

(10) Patent No.: US 7,955,653 B2
(45) Date of Patent: Jun. 7, 2011

(54) INKJET-RECORDING MEDIUM AND METHOD OF PRODUCING THE SAME

(75) Inventors: Kazuyuki Koike, Shizuoka-ken (JP); Hiroki Kubo, Shizuoka-ken (JP); Mitsuhiro Saito, Shizuoka-ken (JP); Hirokazu Kito, Shizuoka-ken (JP)

(73) Assignee: Fujifilm Corporation, Tokyo (JP)

( * ) Notice: Subject to any disclaimer, the term of this patent is extended or adjusted under 35 U.S.C. 154(b) by 1142 days.

(21) Appl. No.: 11/708,639

(22) Filed: Feb. 21, 2007

(65) Prior Publication Data

US 2007/0196598 A1 Aug. 23, 2007

(30) Foreign Application Priority Data

Feb. 22, 2006 (JP) ..... 2006-045578

(51) Int. Cl.
*B05D 3/10* (2006.01)

(52) U.S. Cl. ..... 427/341

(58) Field of Classification Search ..... None
See application file for complete search history.

(56) References Cited

FOREIGN PATENT DOCUMENTS

| | | | |
|---|---|---|---|
| EP | 1484189 | A2 | 8/2004 |
| JP | 2000-211235 | A | 8/2000 |
| JP | 2001-334742 | A | 12/2001 |
| JP | 2005-14593 | A | 1/2005 |
| JP | 2005-271485 | A | 10/2005 |
| JP | 2005-349816 | A | 12/2005 |
| JP | 2006-015655 | A | 1/2006 |

OTHER PUBLICATIONS

Abstracts and partial machine translation of JP 2003-312133, Nov. 2003.*

Japanese Office Action mailed Dec. 8, 2009, issued in JP application 2006-045578.

* cited by examiner

*Primary Examiner* — Erma Cameron
(74) *Attorney, Agent, or Firm* — Sughrue Mion, PLLC

(57) ABSTRACT

An inkjet-recording medium comprising a support and an ink-receiving layer formed thereon containing inorganic fine particles, a water-soluble aluminum compound, a zirconium compound, a cationic modified self-emulsifying polymer, a polyvinyl alcohol having a saponification value of 92 to 98 mol %, and a crosslinking agent, and a method of producing the same.

5 Claims, No Drawings

INKJET-RECORDING MEDIUM AND METHOD OF PRODUCING THE SAME

CROSS-REFERENCE TO RELATED APPLICATION

This application claims priority under 35 USC 119 from Japanese Patent Application No. 2006-45578, the disclosure of which is incorporated by reference herein.

BACKGROUND OF THE INVENTION

1. Field of the Invention

The present invention relates to an inkjet-recording medium, i.e., a recording medium favorably used in inkjet-recording method, and a method of producing the same.

2. Description of the Related Art

In recent rapid progress of the communication industry, various information-processing systems have been developed, and various recording methods and devices suitable for use in these information-processing systems have also been developed and already in use. Among the recording methods above, for example, the inkjet-recording process has been widely used not only in office use but also in so-called home use, because the inkjet process allows printing on various recording materials and the hardware (devices) thereof is relatively cheaper, more compact, and more silent.

In addition, in the recent trend of inkjet printers toward higher-resolution and in the progress of the hardware (devices), a variety of media for inkjet recording has been developed, and more recently, there are some inkjet printers available that allow printing of so-called photographic-like high-quality images.

General requirements in properties for such an inkjet-recording medium include (1) high drying speed (high ink-absorbing speed), (2) favorable and uniform ink dot diameter (without ink bleeding), (3) favorable graininess, (4) high dot circularity, (5) high color density, (6) high color saturation (absence of dullness), (7) excellent light fastness, gas resistance and water resistance of printed image portions, (8) higher whiteness of recording surface, (9) favorable storage stability of recording medium (absence of yellowing and image bleeding during long term storage), (10) deformation resistance and favorable dimensional stability (suppressed curling), (11) favorable traveling characteristics through a machine, and the like. In addition, for application as photographic glazed papers, which are used for printing so-called photographic-like high-quality images, glossiness, surface smoothness, the texture similar to silver halide photographic papers, and the like are also demanded in addition to the properties above.

Known as the inkjet-recording media satisfying the requirements above are, for example, a medium in which an ink-receiving layer is formed on a support by coating a solution containing inorganic fine particles such as vapor-phase-process silica, a mordant such as cationic polymer, a water-soluble resin such as polyvinyl alcohol (PVA), and a hardener for the water-soluble resin (e.g., boric acid) (JP-A No. 2000-211235) and a medium carrying an ink-receiving layer prepared by applying a solution containing a hardener for the water-soluble resin (boric acid, etc.) and thus hardening a coated layer formed on a support by coating a solution containing inorganic fine particles such as vapor-phase-process silica, a metal compound such as a water-soluble metal salt, and a water-soluble resin such as PVA before the coated layer is completely dried (JP-A No. 2001-334742).

Also known is a method of producing an inkjet-recording medium in which an ink-receiving layer of crosslinked and hardened coated layer is formed on a support, comprising forming a coated layer on the support by coating a first liquid containing inorganic fine particles, a water-soluble resin, and a crosslinking agent, and crosslinking and hardening the coated layer by applying a second liquid containing a zirconium compound and an ammonium salt of weak acid on the coated layer, (1) simultaneously with coating of the first liquid or (2) before the coated layer formed by coating the first liquid shows a falling drying rate during drying the coated layer (JP-A No. 2005-14593). It is possible to form an ink-receiving layer tough enough to prohibit problems such as of cracking, superior in ink-absorbing capacity and water resistance, and resistant to yellowing, bronzing and beading, by the production method.

SUMMARY OF THE INVENTION

The present invention has been made in view of the above circumstances and provides an inkjet-recording medium and a method of producing the same.

The invention includes the following aspects:

(1) An inkjet-recording medium comprising a support and an ink-receiving layer formed thereon containing inorganic fine particles, a water-soluble aluminum compound, a zirconium compound, a cationic modified self-emulsifying polymer, a polyvinyl alcohol having a saponification value of 92 to 98 mol %, and a crosslinking agent.

(2) A method of producing an inkjet-recording medium, comprising: preparing a dispersion by counter-colliding inorganic fine particles and a zirconium compound, or by passing inorganic fine particles and a zirconium compound through an orifice, by using a high-pressure dispersing machine; preparing an ink-receiving layer-forming solution by adding a cationic modified self-emulsifying polymer, a polyvinyl alcohol having a saponification value of 92 to 98 mol %, and a crosslinking agent to the dispersion; and forming a coated layer by applying a coating solution prepared by in-line mixing of a water-soluble aluminum compound in the ink-receiving layer-forming solution, on a support.

(3) A method of producing an inkjet-recording medium, comprising: preparing a dispersion by counter-colliding inorganic fine particles, a zirconium compound and a crosslinking agent, or by passing inorganic fine particles, a zirconium compound and a crosslinking agent through an orifice, by using a high-pressure dispersing machine; preparing an ink-receiving layer-forming solution by adding a cationic modified self-emulsifying polymer and a polyvinyl alcohol having a saponification value of 92 to 98 mol % to the dispersion; and forming a coated layer by applying a coating solution prepared by in-line mixing of a water-soluble aluminum compound in the ink-receiving layer-forming solution, on a support.

DETAILED DESCRIPTION OF THE INVENTION

Hereinafter, the inkjet-recording medium according to the present invention and the method of producing the same will be described in detail.

The inkjet-recording medium according to the invention has a support and an ink-receiving layer formed thereon containing inorganic fine particles, a water-soluble aluminum compound, a zirconium compound, a cationic modified self-emulsifying polymer, a polyvinyl alcohol having a saponification value of 92 to 98 mol %, and a crosslinking agent.

Hereinafter, the materials used in the inkjet-recording medium according to the invention will be described.

(Cationic Modified Self-Emulsifying Polymer)

The ink receiving layer of the inkjet recording medium of the invention includes at least a "cationic modified self-emulsifying polymer". This "cationic modified self-emulsifying polymer" means a polymer compound from which can be obtained naturally a stable emulsion dispersion in an aqueous dispersion medium without the addition of emulsifier or surfactant, or if they are used by only adding a trace amount thereof. Quantitatively, the above "cationic modified self-emulsifying polymer" represents polymer substances which have a stable emulsifying ability of a concentration of 0.5 mass % or greater in an aqueous dispersal medium at 25° C. This concentration is preferably 1 mass % or greater, and particularly preferably 3 mass % or greater.

More specific examples of the above "cationic modified self-emulsifying polymer" of the invention are, for example, poly-addition or polycondensation based polymer compounds including cationic groups of primary, secondary or tertiary amine groups, or quaternary ammonium groups.

For the above polymers, vinyl polymerization based polymers obtained by the polymerization of the following vinyl monomers can be used. Examples of the vinyl monomers include: acrylic acid esters and meta acrylic acid esters (the ester group comprises alkyl or aryl group which may have substituents, for example the following groups can be used as alkyl or aryl group, methyl, ethyl, n-propyl, isopropyl, n-butyl, sec-butyl, tert-butyl, hexyl, 2-ethylhexyl, tert-octyl, 2-chloroethyl, cyanoethyl, 2-acetoxyethyl, tetrahydrofurfuryl, 5-hydroxypentyl, cyclohexyl, benzyl, hydroxyethyl, 3-methoxybutyl, 2-(2-methoxyetoxy) ethyl, 2,2,2-tetrafluoroethyl, 1H, 1H, 2H, 2H-perfluorodecyl, phenyl, 2,4,5-tetramethyl phenyl, 4-chlorophenyl);

vinyl esters, specifically aliphatic carboxylic acid vinyl esters which may have substituents (for example, vinyl acetate, vinyl propionate, vinylbutyrate, vinyl isobutyrate, vinylcaproate, vinylchloroacetate), aromatic carboxylic acid esters which may have substituents (for example benzoic acid vinyl ester, 4-methyl benzoic acid vinyl ester, salicylic acid vinyl ester);

acrylic amides specifically acrylic amide, N-mono substituted acrylic amides, N-di substituted acrylic amides (substituents are alkyl, aryl, and silyl group which may have substituents, for example methyl, n-propyl, isopropyl, n-butyl, tert-butyl, tert-octyl, cyclohexyl, benzyl, hydroxy methyl, alkoxy methyl, phenyl, 2,4,5-tetramethyl phenyl, 4-chlorophenyl, trimethyl silyl groups);

methacrylic amides, specifically methacrylic amide, N-mono substituted methacrylic amides, N-di substituted methacrylic amides (substituents are alkyl, aryl, and silyl group which may have substituents, for example methyl, n-propyl, isopropyl, n-butyl, tert-butyl, tert-octyl, cyclohexyl, benzyl, hydroxy methyl, alkoxy methyl, phenyl, 2,4,5-tetramethyl phenyl, 4-chlorophenyl, trimethyl silyl groups);

olefins (for example ethylene, propylene, 1-pentene, vinyl chloride, vinylidene chloride, isoprene, chloroprene, butadiene), styrenes (for example styrene, methylstyrene, isopropylstyrene, methoxystyrene, acetoxystyrene, and chlorostyrene), vinyl ethers (for example methyl vinyl ether, butyl vinyl ether, hexyl vinyl ether, and methoxyethyl vinyl ether).

As the other vinyl monomer, examples include crotonate esters, itaconate esters, maleate diesters, fumarate diesters, methyl vinyl ketone, phenyl vinyl ketone, methoxyethyl vinyl ketone, N-vinyloxazolidone, N-vinylpyrrolidone, methylenemalonnitrile, diphenyl-2-acryloyloxyethyl phosphate, diphenyl-2-methacryloyloxyethyl phosphate, dibutyl-2-acryloyloxyethyl phosphate, dioctyl-2-methacryloyloxyethyl phosphate and the like.

As the above-mentioned monomer having a cationic group, there are, for example, monomers having a tertiary amino group, such as dialkylaminoethyl methacrylates, dialkylaminoethyl acrylates and the like.

As polyurethanes applicable to the cationic modified self-emulsifying polymer, there are, for example, polyurethanes synthesized by the addition polymerization reaction of various combinations of the diol compounds with the diisocyanate compounds listed below.

Specific examples of the above-mentioned diol compound include ethylene glycol, 1,2-propanediol, 1,3-propanediol, 1,2-butanediol, 1,3-butanediol, 2,3-butanediol, 2,2-dimethyl-1,3-propanediol, 1,2-pentanediol, 1,4-pentanediol, 1,5-pentanediol, 2,4-pentanediol, 3,3-dimethyl-1,2-butanediol, 2-ethyl-2-methyl-1,3-propanediol, 1,2-hexanediol, 1,5-hexanediol, 1,6-hexanediol, 2,5-hexanediol, 2-methyl-2,4-pentanediol, 2,2-diethyl-1,3-propanediol, 2,4-dimethyl-2,4-pentanediol, 1,7-heptanediol, 2-methyl-2-propyl-1,3-propanediol, 2,5-dimethyl-2,5-hexanediol, 2-ethyl-1,3-hexanediol, 1,2-octanediol, 1,8-octanediol, 2,2,4-trimethyl-1,3-pentanediol, 1,4-cyclohexanedimethanol, hydroquinone, diethylene glycol, triethylene glycol, dipropylene glycol, tripropylene glycol, polyethylene glycols (average molecular weight=200, 300, 400, 600, 1000, 1500, 4000), polypropylene glycols (average molecular weight=200, 400, 1000), polyester polyols, 4,4'-dihydroxy-diphenyl-2,2-propane, 4,4'-dihydroxyphenylsulfone, and the like.

As the above-mentioned diisocyanate compound, examples include methylene diisocyanate, ethylene diisocyanate, isophorone diisocyanate, hexamethylene diisocyanate, 1,4-cyclohexane diisocyanate, 2,4-toluene diisocyanate, 2,6-toluene diisocyanate, 1,3-xylylene diisocyanate, 1,5-naphthalene diisocyanate, m-phenylene diisocyanate, p-phenylene diisocyanate, 3,3'-dimethyl-4,4'-diphenylmethane diisocyanate, 3,3'-dimethylbiphenylene diisocyanate, 4,4'-biphenylene diisocyanate, dicyclohexylmethane diisocyanate, methylene bis(4-cyclohexyl isocyanate), and the like.

As the cationic group contained in the cationic group-containing polyurethane, there are cationic groups such as primary, secondary and tertiary amines and quaternary ammonium salts. In the cationic modified self-emulsifying polymer of the invention, it is preferable to use a urethane resin with cationic groups such as tertiary amines or quaternary ammonium salts. The cationic group-containing polyurethanes can be obtained, for example, by using a material which is obtained by introducing cationic groups into the diols mentioned above at the time of synthesizing the polyurethane. Also, in the case of quaternary ammonium salts, polyurethanes containing tertiary amino groups can be quaternized with a quaternizing agent.

The diol compounds and diisocyanate compounds usable for synthesizing the polyurethane may be used each alone, or may be used in combinations of two or more in various proportions decided depending on the purpose (for example, control of the polymer glass transition temperature (Tg), improving solubility, providing compatibility with a binder, and improving stability of a dispersion).

As the polyester applicable to the cationic modified self-emulsifying polymer, there are, for example, polyesters synthesized by polycondensation reactions of various combinations of the diol compounds with the dicarboxylic acid compounds listed below.

As the above-mentioned dicarboxylic acid compounds, there are listed oxalic acid, malonic acid, succinic acid, glutaric acid, dimethylmaleic acid, adipic acid, pimelic acid, α,α-dimethylsuccinic acid, acetonedicarboxylic acid, sebacic acid, 1,9-nonanedicarboxylic acid, fumaric acid, maleic acid, itaconic acid, citraconic acid, phthalic acid, isophthalic acid, terephthalic acid, 2-butylterephthalic acid, tetrachloroterephthalic acid, acetylenedicarboxylic acid, poly(ethyleneterephthalate)dicarboxylic acid, 1,2-cyclohexanedicarboxylic acid, 1,4-cyclohexanedicarboxylic acid, ω-poly(ethyleneoxide)dicarboxylic acid, p-xylylenedicarboxylic acid and the like.

The above-mentioned dicarboxylic acid compound may, when polycondensed with a diol compound, be used in the form of an alkyl ester (for example, dimethyl ester) of a dicarboxylic acid or an acid chloride of a dicarboxylic acid, or be used in the form of an acid anhydride such as maleic anhydride, succinic anhydride and phthalic anhydride.

As the diol compound, the same compounds as the diols exemplified for the above-mentioned polyurethane can be used.

The cationic group-containing polyester can be obtained by synthesis using a dicarboxylic acid compound having a cationic group such as primary, secondary and tertiary amines and quaternary ammonium salts.

The above-mentioned diol compounds, dicarboxylic acids and hydroxycarboxylate ester compounds used in synthesis of the polyester may each be used alone, or may be used in combinations of two or more in selected proportions depending on the purpose (for example, control of the polymer glass transition temperature (Tg), solubility, compatibility with dyes, and stability of dispersion).

The content of the cationic group in the cationic modified self-emulsifying polymer is preferably from 0.1 to 5 mmol/g, and more preferably from 0.2 to 3 mmol/g. When the content of the cationic group is too low, the polymer dispersion stability decreases, and when too high, binder compatibility decreases.

The above cationic modified self-emulsifying polymers preferably are polymers having a cationic group such as a tertiary amine group or a quaternary ammonium base, and most preferable are urethane resins (polyurethane) having a cationic group like the ones above.

When the above self-emulsifying polymers are used in an ink receiving layer of the invention, particularly important is the glass transition temperature thereof. After forming an image by inkjet recording, in order to suppress the occurrence of bleeding of the image with the passage of time, the glass transition temperature of the above self-emulsifying polymer is preferably below 50° C. Further, the self-emulsifying polymer glass transition temperature is more preferably 30° C. or below, and even particularly preferable is a glass transition temperature of 15° C. or below. If the glass transition temperature is 50° C. or above then the dimensional stability (curl) worsens. Here, there is no particular lower limit to the glass transition temperature but, for normal applications it is of the order of −30° C., and if it is lower than this then when preparing the aqueous dispersant the manufacturability can be reduced.

For the mass average of the molecular weight of the self-emulsifying polymer used in the invention, usually this is preferably 1000 to 200,000, and 2000 to 50,000 is more preferable. If the molecular weight is less than 1000 then there is a tendency that obtaining a stable aqueous dispersant becomes difficult. If the molecular weight exceeds 200,000 then the solubility decreases, the viscosity of the liquid increases and the controlling to a small average particle size of the particles of aqueous dispersant tends to become difficult, particularly controlling to 0.05 μm or less.

Regarding the amount of the above self-emulsifying polymer to be included in the ink receiving layer of the invention, this is preferably in the range of 0.1 to 20 mass % relative to the total solid contents in the structure of the ink receiving layer, 0.3 to 20 mass % is more preferable and 0.5 to 15 mass % is most favorable. If the above amount included is less than 0.1 mass % then there is insufficient improvement in the bleeding which occurs with the passage of time. On the other hand, if the amount included is over 30 mass % then the proportion of fine particles or binder components, such as inorganic fine particles and polyvinyl alcohol, gets smaller, and the ink absorption ability on a high quality image recording paper tends to be reduced.

Next, the preparation method of the aqueous dispersion of the self-emulsifying polymer of the invention will be explained.

The above self-emulsifying polymer is mixed into an aqueous solvent medium, and as required additives are mixed in, and by fragmenting the mixture liquid using a dispersal apparatus, an aqueous dispersion with an average particle size of 0.05 μm or below can be obtained. In order to obtain the aqueous dispersion, various known dispersal apparatuses such as the following can be used: high speed rotary dispersal apparatus, a medium agitation type dispersal apparatus (such as a ball mill, sand mill, and bead mill), ultra-sound dispersal apparatus, colloid mill dispersal apparatus, high pressure dispersal apparatus. However, from the perspective of efficiently dispersing the clump-like fine particles, a medium agitation type dispersal apparatus, colloid mill dispersal apparatus or high pressure dispersal apparatus are preferable.

As a high pressure dispersal apparatus (homogenizer), a detailed mechanism is described in U.S. Pat. No. 4,533,254, JP-A No. 6-47264 and the like, but commercially available apparatuses such as GAULIN HOMOGENIZER (A.P.V Gaulin Inc.), MICROFLUIDIZER (Microfluidex Inc.), ALTIMIZER (Sugino Machine K.K.) can be used. Recently, a high pressure homogenizer equipped with a mechanism to form fine particles in an ultrahigh pressure jet flow as described in U.S. Pat. No. 5,720,551 is particularly effective for emulsifying dispersion of the present invention. DeBEE2000 (Bee International Ltd.) is as an example of an emulsifying apparatus using an ultrahigh pressure jet flow.

For the aqueous medium used in the above dispersing process, water, organic solvent media, or mixture media thereof can be used. Useable organic solvent media for the dispersing are: alcohols such as methanol, ethanol, n-propanol, i-propanol, and methoxy propanol; ketones such as acetone, methyl ethyl ketone; tetrahydrofuran, acetonitrile, ethyl acetate, toluene.

With the above self-emulsifying polymer of the present invention, while with the polymer itself a stable emulsion dispersion can be obtained naturally, in order to speed up the emulsifying dispersion and to make it more stable, a small amount of dispersant (surfactant) can be used. For this purpose various surfactants can be used. Preferable examples are anionic surfactants such as fatty acid salts, alkylsulfate ester salts, alkylbenzenesulfonate salts, alkylnaphthalenesulfonate salts, dialkylsulfosuccinate salts, alkylphosphate ester salts, naphthalenesulfonic acid formalin condensates, polyoxyethylene alkylsulfate ester salts and the like. And nonionic surfactants such as polyoxyethylene alkyl ethers, polyoxyethylene alkylaryl ether, polyoxyethylene fatty acid esters, sorbitan fatty acid esters, polyoxyethylene sorbitan fatty acid esters, polyoxyethylene alkyl amines, glycerine fatty acid esters, oxyethylene oxypropylene block copolymers and the like. Further, SURFYNOLS (Air Products & Chemicals), an acetylene-based polyoxyethylene oxide surfactant is also preferably used. Furthermore, amine oxide type ampholytic surfactants such as N,N-dimethyl-N-alkylamine oxide, and the like are also preferable. Further, surfactants listed in JP-A No. 59-157, 636, pp. (37) to (38) and Research Disclosure No. 308119 (1989) can be used.

For obtaining stability directly after emulsification, a water-soluble polymer can also be added together with the above-mentioned surfactant. As the water-soluble polymer, polyvinyl alcohols, polyvinyl pyrrolidone, polyethylene oxide, polyacrylic acid, polyacrylamide, and copolymers thereof are preferably used. Further, it is also preferable to use naturally occurring water-soluble polymers such as polysaccharides, casein, gelatin and the like.

In the above emulsifying dispersing method, when dispersing the above self-emulsifying polymer in an aqueous medium, particularly important is control of the particle size. When forming an image using an inkjet process, in order to raise the color purity and the color density, it is necessary to make the average size of the particles of the self-emulsifying polymer of the above aqueous dispersion small. Specifically, in the ink receiving layer of the invention, it is necessary to make the volume average particle size 0.05 μm or less, and preferably 0.04 μm or less, and 0.03 μm or less if even more preferable.

(Inorganic Fine Particles)

The ink receiving layer according to the present invention contains inorganic fine particles. Examples of the inorganic fine particles include silica fine particles, colloidal silica, titanium dioxide, barium sulfate, calcium silicate, zeolite, kaolinite, halloysite, mica, talc, calcium carbonate, magnesium carbonate, calcium sulfate, boehmite, pseudoboehmite. Among these fine particles, silica fine particles are preferable.

The silica fine particle in the above has an extremely high specific surface area, and provides the layer with a higher ink absorption and retention capacity. In addition, the silica has a low refractive index, and thus if dispersed to a suitable fine particle diameter, provides the ink receiving layer with better transparency, and higher color density and favorable coloring is obtainable. The transparency of ink receiving layer is important from the viewpoint of obtaining a high color density, coloring property and favorable coloring glossiness not only for applications wherein the transparency is required such as OHP sheets and the like, but also for applications as recording sheets such as photographic glossy papers and the like.

The average primary particles diameter of the inorganic fine particles is preferably 20 nm or less, more preferably 15 nm or less, and particularly preferably 10 nm or less. When the average primary particle size of the particles is 20 nm or less, the ink-absorbing property can be effectively improved and at the same time, the glossiness of the surface of the ink receiving layer can be enhanced.

The specific surface area of the inorganic fine particle as determined by the BET method is preferably 200 $m^2/g$ or more, more preferably 250 $m^2/g$ or more, and still more preferably 380 $m^2/g$ or more. Inorganic fine particles having a specific surface area of 200 $m^2/g$ or more give an ink image-receiving layer higher in transparency and printing density.

The BET method used in the invention is a method of determining the surface area of powder by gas-phase adsorption, more specifically a method of determining the specific surface area, i.e., the total surface area per g of a sample, from the absorption isotherm. Nitrogen gas is commonly used as the adsorption gas, and most widely used is a method of determining the amount of adsorption by the change in pressure or volume of the adsorbed gas. One of the most famous equations describing the adsorption isotherm of multi-molecular system is the equation of Brunauer, Emmett, and Teller (BET equation). The surface area is calculated by multiplying the adsorption amount determined by the BET equation by the surface area occupied by a single adsorbed molecule.

In particular with silica fine particles, since the surface has silanol groups, there is easy adhesion between the particles through the hydrogen bonding of the silanol groups, and there is an adhesion effect between the particles through the silanol groups and the water soluble resin. Hence, if the average primary size of the particles is 20 nm or below, then the porosity ratio of the ink receiving layer is high, and a structure with high transparency can be formed, and the ink absorption characteristics can be effectively raised.

Silica fine particles are commonly classified roughly into wet method particles and dry method (vapor phase process) particles according to the method of manufacture. By the wet method, silica fine particles are mainly produced by generating an activated silica by acid decomposition of a silicate, polymerizing to a proper degree the activated silica, and coagulating the resulting polymeric silica to give a hydrated silica. Alternatively by the vapor phase process, anhydrous silica particles are mainly produced by high-temperature vapor phase hydrolysis of a silicon halide (flame hydrolysis process), or by reductively heating and vaporizing quartz and coke in an electric furnace by applying an arc discharge and then oxidizing the vaporized silica with air (arc method). The "vapor-phase process silica" means an anhydrous silica fine particle produced by a vapor phase process.

The vapor-phase process silica is different in the density of silanol groups on the surface and the presence of voids therein and exhibits different properties from hydrated silica. The vapor-phase process silica is suitable for forming a three-dimensional structure having a higher void percentage. The reason is not clearly understood. In the case of hydrated silica fine particles have a higher density of 5 to 8 silanol groups/$nm^2$ on their surface. Thus the silica fine particles tend to coagulate densely. While the vapor phase process silica particles have a lower density of 2 to 3 silanol groups/$nm^2$ on their surface. Therefore, vapor-phase process silica seems to cause more scarce, softer coagulations (flocculates), consequently leading to a structure having a higher void percentage.

In the present invention, the vapor-phase-process silica fine particles (anhydrous silica) obtained by the dry method is preferable, with the surface of the silica fine particles having a density of 2 to 3 silanol groups/$nm^2$.

The inorganic fine particles favorably used in the invention are particles of a vapor-phase-process silica having a BET specific surface area of 200 $m^2/g$ or more.

(Polyvinyl Alcohol)

The polyvinyl alcohol for use in the invention has a saponification value of 92 to 98 mol % (hereinafter, referred to as "polyvinyl alcohol according to the invention"). A polyvinyl alcohol having a saponification value of lower than 92 mol % is undesirable, because it leads to a halftone image not in neutral gray. It also leads to increase in the viscosity and to deterioration in the coating stability of coating solution. On the other hand, a polyvinyl alcohol having a saponification value of more than 98 mol % is also undesirable, because it leads to decrease in ink-absorbing capacity. The saponification value is more preferably 93 to 97 mol %.

The polymerization degree of the polyvinyl alcohol according to the invention is preferably 1,500 to 3,600, more preferably 2,000 to 3,500. A polyvinyl alcohol having a polymerization degree of more than 1,500 makes the ink-receiving layer more resistant to cracking. A polymerization degree of less than 4,000 is preferable, because such a polyvinyl alcohol leads to decrease in the viscosity of coating solution.

A water-soluble resin other than the polyvinyl alcohol according to the invention may be used in combination with the polyvinyl alcohol in the invention. Examples of the water-soluble resins for use in combination include polyvinyl alcohols (PVAs) having a hydroxyl group as a hydrophilic structural unit and a saponification value outside the range above, cationic modified polyvinyl alcohols, anionic modified polyvinyl alcohols, silanol-modified polyvinyl alcohols, polyvinylacetal, cellulosic resins (methylcellulose (MC), ethylcellulose (EC), hydroxyethylcellulose (HEC), carboxymethylcellulose (CMC), hydroxypropylcellulose (HPC), etc.), chitins, chitosans, and starch; hydrophilic ether bond-containing resins such as polyethylene oxide (PEO), polypropylene oxide (PPO), polyethylene glycol (PEG), and polyvinylether (PVE); hydrophilic amide group- or amide bond-containing resins such as polyacrylamide (PAAM) and polyvinyl pyrrolidone (PVP); and the like. Other examples include compounds having a carboxyl group as a dissociative group such as polyacrylate salts, maleic acid resins, alginate salts, gelatins, and the like. When the polyvinyl alcohol according to the invention and the water-soluble resin described above are used in combination, the rate of the polyvinyl alcohol according to the invention in the total amount of the polyvinyl alcohol according to the invention and the water-soluble resin is preferably 1 to 30 wt %, more preferably 3 to 20 wt %, and still more preferably 6 to 12 wt %.

In order to prevent reduction of layer strength or layer cracking at the time when the layer is dried, due to too small a content of the water-soluble resin, and prevent reduction of ink absorbing ability caused by blocking of voids by resin due to too high a content of resin, the content of the polyvinyl alcohol of the present invention is preferably 9 to 40%, more, preferably 12 to 33% by mass with respect to the total solid mass in ink receiving layer.

The above polyvinyl alcohol resins contain a hydroxyl group as a structural unit. Hydrogen bonding between the hydroxyl groups and the surface silanol groups on silica fine particles allows the silica fine particles to form a three-dimensional network structure having secondary particles as the network chain units. This three-dimensional network structure thus constructed seems to be the cause of easier development of an ink receiving layer having a porous structure having a higher void percentage.

In ink jet recording medium, the ink receiving layer having a porous structure obtained in this manner absorbs inks rapidly due to the capillary phenomenon, and provides printed dots superior in circularity without ink bleeding.

<Content Ratio of the Inorganic Fine Particles to the Polyvinyl Alcohol of the Present Invention>

A ratio of inorganic fine particles (preferably, silica fine particles; x) and polyvinyl alcohol of the invention (when the polyvinyl alcohol is used in combinations of other water-soluble resin, a total mass of water-soluble resins is represented by "y") to be contained [PB ratio (x/y), mass of inorganic fine particles relative to 1 part by mass of polyvinyl alcohol of the invention] greatly influences also on a film structure of an ink receiving layer. That is, as a PB ratio grows larger, a porosity, a micropore volume and a specific surface area (per unit mass) grow larger.

Specifically, the PB ratio (x/y) is preferably 1.5/1 to 10/1 from a viewpoint that reduction in the film strength and cracking at drying due to too large PB ratio are prevented, and due to too small PB ratio, a void is easily filled with a resin, and a porosity is reduced, and reduction in the ink absorbing property is prevented.

When conveyed in paper-conveying systems of ink jet printers, a stress may be applied to the ink jet recording medium. Accordingly, the ink receiving layer should have sufficiently high layer strength. Also from the viewpoints of preventing cracking, peeling, or the like of the ink receiving layer when the ink jet recording medium are cut into sheets, the ink receiving layer should have sufficiently high layer strength. Considering the above, the PB ratio is preferably 5/1 or less. On the other hand, from the viewpoint of ensuring the superior ink absorptive property in ink jet printers, the ratio is more preferably 2/1 or more.

For example, when a coating liquid, containing anhydrous silica fine particles having an average primary particle diameter of 20 nm or less and the polyvinyl alcohol of the present invention, and a water-soluble resin homogeneously dispersed in an aqueous solution at a PB ratio (x/y) of between 2/1 and 5/1, is applied and dried on a support, a three-dimensional network structure having the secondary particles of silica fine particles as the network chains is formed. Such a coating liquid easily provides a translucent porous layer having an average void diameter of 30 nm or less, a void percentage of 50 to 80%, a void specific volume of 0.5 ml/g or more, and a specific surface area of 100 $m^2/g$ or more.

(Crosslinking Agent)

The ink-receiving layer according to the invention contains a crosslinking agent. The ink-receiving layer according to the invention is preferably a porous layer of the polyvinyl alcohol according to the invention and the water-soluble resin used as needed that are hardened in crosslinking reaction by the crosslinking agent.

The above crosslinking agent may be selected appropriately in relation to the polyvinyl alcohol of the present invention and the water-soluble resin to be used as desired contained in the ink receiving layer, but boron compounds are preferable, as they allow faster crosslinking reaction. Examples of the boron compounds include borax, boric acid, borate salts [e.g., orthoborate salts, $InBO_3$, $ScBO_3$, $YBO_3$, $LaBO_3$, $Mg_3(BO_3)_2$, and $Co_3(BO_3)_2$], diborate salts [e.g., $Mg_2B_2O_5$, and $Co_2B_2O_5$], metaborate salts [e.g., $LiBO_2$, $Ca(BO_2)_2$, $NaBO_2$, and $KBO_2$], tetraborate salts [e.g., $Na_2B_4O_7.10H_2O$], pentaborate salts [e.g., $KB_5O_8.4H_2O$, $Ca_2B_6O_{11}.7H_2O$, and $CsB_5O_5$], and the like. Among them, borax, boric acid and borates are preferable since they are able to promptly cause a cross-linking reaction. Particularly, boric acid or a borate salt is preferable, and the combination of this and polyvinyl alcohol, which is a water-soluble resin, is most preferred.

In the invention, the above cross-linking agent is preferably included to an amount of 0.05 to 0.50 parts by weight relative to 1 part by weight of the polyvinyl alcohol of the present invention. More preferable is an inclusion amount of 0.08 to 0.30 parts by weight. If the amount of inclusion of the cross-linking agent is within the above ranges then the polyvinyl alcohol of the present invention can be effectively be cross-linked and development of cracks and the like can be prevented.

When gelatin is used as a water-soluble resin in the invention, other compounds than the boron compounds, as described below, can be used for the cross-linking agent of the water-soluble resin.

Examples of such cross-linking agents include: aldehyde compounds such as formaldehyde, glyoxal and glutaraldehyde; ketone compounds such as diacetyl and cyclopentanedione; active halogen compounds such as bis(2-chloroethylurea)-2-hydroxy-4,6-dichloro-1,3,5-triazine and 2,4-dichloro-6-S-triazine sodium salt; active vinyl compounds such as divinyl sulfonic acid, 1,3-vinylsulfonyl-2-propanol, N,N'-ethylenebis(vinylsulfonylacetamide) and 1,3,5-triacryloyl-hexahydro-S-triazine; N-methylol compounds such as dimethylolurea and methylol dimethylhydantoin; melamine resin such as methylolmelamine and alkylated methylolmelamine; epoxy resins;

isocyanate compounds such as 1,6-hexamethylenediisocyanate; aziridine compounds such as those described in U.S. Pat. Nos. 3,017,280 and 2,983,611; carboxyimide compounds such as those described in U.S. Pat. No. 3,100,704; epoxy compounds such as glycerol triglycidyl ether; ethyleneimino compounds such as 1,6-hexamethylene-N,N'-bisethylene urea; halogenated carboxyaldehyde compounds such as mucochloric acid and mucophenoxychloric acid; dioxane compounds such as 2,3-dihydroxydioxane; metal-containing compounds such as titanium lactate, aluminum sulfate, chromium alum, potassium alum, zirconyl acetate and chromium acetate; polyamine compounds such as tetraethylene pentamine; hydrazide compounds such as adipic acid dihydrazide; and low molecular compounds or polymers containing at least two oxazoline groups. These crosslinking agents may be used alone, or in combinations of two or more thereof.

(Water-Soluble Aluminum Compound)

The ink-receiving layer according to the invention contains a water-soluble aluminum compound. Presence of a water-soluble aluminum compound is effective in improving the water resistance and ink-bleeding resistance during long term storage of the formed image.

Examples of the water-soluble aluminum compounds include inorganic salts such as aluminum chloride or the hydrates thereof, aluminum sulfate or the hydrates thereof, ammonium alum, and the like. Other examples include inorganic aluminum-containing cationic polymers such as basic polyaluminum hydroxide compounds. Among them, basic polyaluminum hydroxide compounds are preferable.

The above basic polyaluminum hydroxide compounds are water soluble polyaluminum hydroxide compounds stably including multi-nucleated condensate ions of basic polymers, such as $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, and the major components thereof are represented by the following formulae.

$$[Al_2(OH)_nCl_{6-n}]_m 5<m<80,\ 1<n<5 \quad \text{Formula 1}$$

$$[Al(OH)_3]_nAlCl_3 1<n<2 \quad \text{Formula 2}$$

$$Al_n(OH)_mCl_{(3n-m)} 0<m<3n, 5<m<8 \quad \text{Formula 3}$$

These compounds of various grades can be easily obtained and are placed on the market by Taki Chemical Co. Ltd. as polyaluminum chloride (PAC) as water treatment agents, by Asada Kagaku Co. Ltd. as polyhydrated aluminium (Paho), also by Rikengreen Co. Ltd., as pyurakem WT, Taimei Chemicals Co. Ltd., as alphaine 83, and other manufacturers for the same purpose. In the invention it is suitable to use the commercially available products directly, but since there are materials which have inappropriately low pH values, in these cases it is possible to use by suitably adjusting the pH.

The content of the water-soluble aluminum compound in the ink-receiving layer according to the invention is preferably 0.1 to 20 wt %, more preferably 1 to 8 wt %, and most preferably 2 to 4 wt %, with respect to the total solids in the ink-receiving layer. A water-soluble aluminum compound content in the range of 2 to 4 wt % is effective in improving glossiness, water resistance, gas resistance, and light stability.

(Zirconium Compound)

The ink-receiving layer according to the invention contains a zirconium compound. Use of the zirconium compound allows improvement in water resistance.

The zirconium compound for use in the invention is not particularly limited, and various compounds may be use, and typical examples thereof include zirconyl acetate, zirconium chloride, zirconium oxychloride, zirconium hydroxychloride, zirconium nitrate, basic zirconium carbonate, zirconium hydroxide, zirconium ammonium carbonate, zirconium potassium carbonate, zirconium sulfate, zirconium fluoride compound, and the like. Zirconyl acetate is particularly preferable.

The content of the zirconium compound in the ink-receiving layer according to the invention is preferably 0.05 to 5.0 wt %, more preferably 0.1 to 3.0 wt %, and particularly preferably 0.5 to 2.0 wt %, with respect to the total solids in the ink-receiving layer. A zirconium compound content in the range of 0.5 to 2.0 wt % allows improvement in water resistance without deterioration in ink-absorbing efficiency.

In the invention, a water-soluble polyvalent metal compound other than the water-soluble aluminum compound and the zirconium compound described above may be used in combination. Examples of the other water-soluble polyvalent metal compounds include water-soluble salts of a metal selected from calcium, barium, manganese, copper, cobalt, nickel, iron, zinc, chromium, magnesium, tungsten, and molybdenum.

Typical examples thereof include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, cupric chloride, ammonium copper (II) chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidosulfate tetrahydrate, ferrous bromide, ferrous chloride, ferric chloride, ferrous sulfate, ferric sulfate, zinc bromide, zinc chloride, zinc nitrate hexahydrate, zinc sulfate, chromium acetate, chromium sulfate, magnesium sulfate, magnesium chloride hexahydrate, magnesium citrate nonahydrate, sodium phosphotungstate, sodium tungsten citrate, dodecatungstophosphoric acid n-hydrate, dodecatungstosilicic acid 26-hydrate, molybdenum chloride, dodecamolybdophosphoric acid n-hydrate, and the like.

(Other Components)

In addition, the ink receiving layer of the present invention is constructed to contain the following components if necessary.

To restrain the deterioration of the ink colorant, anti-fading agents such as various ultraviolet absorbers, antioxidants and singlet oxygen quenchers may be contained.

Examples of the ultraviolet absorbers include cinnamic acid derivatives, benzophenone derivatives and benzotriazolyl phenol derivatives. Specific examples include α-cyanophenyl cinnamic acid butyl ester, o-benzotriazole phenol, o-benzotriazole-p-chlorophenol, o-benzotriazole-2,4-di-t-butyl phenol, o-benzotriazole-2,4-di-t-octyl phenol. A hindered phenol compound can be also used as an ultraviolet absorber, and phenol derivatives in which at least one or more of the second place and/or the sixth place is substituted by a branching alkyl group is preferable.

A benzotriazole based ultraviolet absorber, a salicylic acid based ultraviolet absorber, a cyano acrylate based ultraviolet absorber, and oxalic acid anilide based ultraviolet absorber or the like can be also used. For instance, the ultraviolet absorbers as described in JP-A Nos. 47-10537, 58-111942, 58-212844, 59-19945, 59-46646, 59-109055 and 63-53544, Japanese Patent Application Publication (JP-B) Nos. 36-10466, 42-26187, 48-30492, 48-31255, 48-41572 and 48-54965, 50-10726, U.S. Pat. Nos. 2,719,086, 3,707,375, 3,754,919 and 4,220,711 or the like.

An optical whitening agent can be also used as an ultraviolet absorber, and specific examples include a coumalin based optical whitening agent. Specific examples are described in JP-B Nos. 45-4699 and 54-5324 or the like.

Examples of the antioxidants are described in EP 223739, 309401, 309402, 310551, 310552 and 459416, D.E. Pat. No. 3435443, JP-A Nos. 54-48535, 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 62-262047, 63-051174, 63-89877, 63-88380, 66-88381, 63-113536, 63-163351, 63-203372, 63-224989, 63-251282, 63-267594, 63-182484, 1-239282, 2-262654, 2-71262, 3-121449, 4-291685, 4-291684, 5-61166, 5-119449, 5-188687, 5-188686, 5-110490, 5-1108437 and 5-170361, JP-B Nos. 48-43295 and 48-33212, U.S. Pat. Nos. 4,814,262 and 4,980,275.

Specific examples of the antioxidants include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethy-1,2,3,4-tetrahydroquinoline, 6-ethoxy-1-octyl-2,2,4-trimethyl-1,2,3,4,-tetrahydroquinoline, nickel cyclohexanoate, 2,2-bis(4-hydroxyphenyl) propane, 1,1-bis(4-hydroxyphenyl)-2-ethylhexane, 2-methy-4-methoxy-diphenyl amine, 1-methyl-2-phenyl indole.

These anti-fading agents can be used alone or in combinations of two or more. The anti-fading agents can be dissolved in water, dispersed, emulsified, or they can be included within microcapsules. The amount of the anti-fading agents added is preferably 0.01 to 10% by mass, relative to the total ink receiving layer coating liquid.

In the invention, in order to prevent curl, it is preferable to include organic solvents with a high boiling point in the ink receiving layer.

For the above high boiling point organic solvents water soluble ones are preferable. As water soluble organic solvents with high boiling points the following alcohols are examples: ethylene glycol, propylene glycol, diethylene glycol, triethylene glycol, glycerin, diethylene glycol monobutylether (DEGMBE), triethylene glycol monobutyl ether, glycerin monomethyl ether, 1,2,3-butane triol, 1,2,4-butane triol, 1,2,4-pentane triol, 1,2,6-hexane triol, thiodiglycol, triethanolamine, polyethylene glycol (average molecular weight of less than 400). Diethylene glycol monobutylether (DEGMBE) is preferable.

The amount of the above high boiling point organic solvents used in the coating liquid for the ink receiving layer is preferably 0.05 to 1% by mass, and particularly favorable is 0.1 to 0.6% by mass.

Also, for the purpose of increasing the dispersability of the inorganic fine particles, inorganic salts, and acids or alkalis, for the pH adjuster, can be included Further, in order to suppress the generation of friction charging and exfoliation charging on the surface, conductive metallic oxide fine particles, and matting agents, for reducing the surface friction, can be included.

(Support)

Both a transparent support of a transparent material such as plastic and an opaque support of an opaque material such as paper may be used as the support. Use of a transparent support or an opaque high-glossiness support is preferable, for making the most of the transparency of ink-receiving layer. It is also possible to use a read-only optical disk such as CD-ROM or DVD-ROM, a write once optical disk such as CD-R or DVD-R, or rewritable optical disk as the support and form an ink-receiving layer on the label face thereof.

Material which is transparent and can endure radiant heat when used on OHPs and a backlight display is preferable as a material which can be used for the above transparent support. Examples of the material include polyesters such as polyethylene terephthalate (PET); polysulfone, polyphenylene oxide, polyimide, polycarbonate and polyamide. The polyesters are preferable among them, and especially, polyethylene terephthalate is preferable.

The thickness of the transparent support is not particularly limited. However, a thickness of 50 to 200 μm is preferable in view of ease of use.

An opaque support having high glossiness whose surface on which the ink receiving layer is formed has a glossiness degree of 40% or more is preferable. The glossiness degree is a value determined according to the method described in JIS P-8142 (paper and a paperboard 75 degree method for examining specular glossiness degree). Specific examples of such supports include the following supports.

Examples include paper supports having high glossiness such as art paper, coat paper, cast coat paper and baryta paper used for a support for a silver salt photography or the like; polyesters such as polyethylene terephthalate (PET), cellulose esters such as nitrocellulose, cellulose acetate and cellulose acetate butyrate, opaque high glossiness films which are constituted by incorporating white pigment or the like in plastic films such as polysulfone, polyphenylene oxide, polyimide, polycarbonate and polyamide (a surface calendar treatment may be performed); or, supports in which a coating layer made of polyolefin which either does or does not contain a white pigment is formed on the surface of the various paper supports, transparent supports or a high glossiness film containing white pigment or the like.

Also, white pigment-containing foam polyester film (for instance, a foam PET which contains the polyolefin fine particles, and contains voids formed by drawing out) is preferable. Further, a resin coated paper to be used for a printing paper for silver halide salt photographic use is suitable.

The thickness of the opaque support is not particularly limited. However, a thickness of 50 to 300 μm is preferable in view of ease of handling.

The surface of the support may be treated by corona discharge treatment, glow discharge treatment, flame treatment or ultraviolet radiation treatment or the like, so as to improve wetting and adhesion properties.

Next, base paper used for paper support, such as resin coated paper, will be described.

The base paper is mainly made of wood pulp, and is made by using a synthetic pulp, such as polypropylene, in addition to the wood pulp if necessary, or a synthetic fiber such as nylon or polyester. LBKP, LBSP, NBKP, NBSP, LDP, NDP, LUKP and NUKP can be used as the wood pulp. It is preferable to use more LBKP, NBSP, LBSP, NDP and LDP which contain a lot of short fibers. The ratio of LBSP and/or LDP is preferable in the range between 10% by mass and 70% by mass.

A chemical pulp with few impurities (sulfate pulp and sulfite pulp) is preferably used as the pulp, and a pulp in which whiteness is improved by bleaching, is useful.

Sizing agents such as higher fatty acid and alkyl ketene dimer, white pigments such as calcium carbonate, talc and titanium oxide, paper reinforcing agents such as starch, polyacrylamide and polyvinyl alcohol, optical whitening agents, water retention agents such as polyethylene glycols, dispersing agents, and softening agents such as a quaternary ammonium can be appropriately added to the base paper.

The freeness of pulp used for papermaking is preferably 200 to 500 ml as stipulated in CSF. The sum of 24 mesh remainder portions and 42 mesh remainder portions is preferably 30 to 70% by mass as stipulated in JIS P-8207. 4 mesh remainder portion is preferably 20% by mass.

The basis weight of the base paper is preferably 30 to 250 g, and particularly preferably 50 to 200 g. The thickness of the base paper is preferably 40 to 250 μm. High smoothness can be imparted to the base paper by calendar treatment at the making paper step or after paper making. The density of the base paper is generally 0.7 to 1.2 g/m$^2$ (JIS P-8118). In addition, the strength of the base paper is preferably 20 to 200 g under the conditions of JIS P-8143.

A surface size agent may be coated on the surface of the base paper, and a size agent which is the same as size which can be added to the base paper can be used as the surface size agent. It is preferable that the pH of the base paper is 5 to 9 when measured by a hot water extraction method provided by JIS P-8113.

In general, the both front and back surfaces of the base paper can be coated with polyethylene. Main examples of polyethylenes include low density polyethylene (LDPE) and/or high density polyethylene (HDPE) but others such as LLDPE and polypropylene can be also used in part.

Especially, in the polyethylene layer on the side on which the ink receiving layer is formed, it is preferable that rutile type or anatase type titanium oxide, an optical whitening agent or ultramarine blue pigment are added to polyethylene, and thereby the degree of opaqueness, whiteness and hue are improved, as is widely performed for printing papers for photographs. Herein, the content of titanium oxide is preferably about 3 to 20% by mass, and more preferably 4 to 13% by mass to polyethylene. The thickness of the polyethylene layer is not limited to a particular thickness, and more preferably 10 to 50 μm. Further, an undercoat layer can be formed to give adhesion of the ink receiving layer on the polyethylene layer. Water soluble polyester, gelatin, and PVA are preferably used as the undercoat layer. The thickness of the undercoat layer is preferably 0.01 to 5 μm.

A polyethylene coated paper sheet may be used as glossy paper, or when polyethylene is coated on the surface of the base paper sheet by melt-extrusion a matte surface or silk finish surface may be formed by applying an embossing treatment, as obtainable in usual photographic printing paper sheets.

On the support body a back coat layer can be provided, and white pigments, water soluble binders and other components can be used as additive components of the back coat layer.

Examples of the white pigment contained in the back coat layer include inorganic white pigments such as calcium carbonate light, calcium carbonate heavy, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, lithopone, zeolite, hydrated halloysite, magnesium carbonate and magnesium hydroxide; and organic pigments such as styrene based plastic pigments, acrylic based plastic pigments, polyethylene, microcapsules, urea resin and melamine resin Examples of the aqueous binders used for the back coat layer include water soluble polymers such as styrene/maleic acid copolymer, styrene/acrylate copolymer, polyvinyl alcohol, silanol modified polyvinyl alcohol, starch, cationic starch, casein, gelatin, carboxymethyl cellulose, hydroxyethyl cellulose and polyvinyl pyrrolidone; and water dispersible polymers such as styrene-butadiene latex and acrylic emulsion.

Other components contained in the back coat layer include defoaming agents, foaming suppressing agents, dyes, optical whitening agents, preservatives and water-proofing agents.

The first method of producing an inkjet-recording medium according to the invention comprises preparing a dispersion by counter-colliding inorganic fine particles and a zirconium compound, or by passing inorganic fine particles and a zirconium compound through an orifice, by using a high-pressure dispersing machine; preparing an ink-receiving layer-forming solution by adding a cationic modified self-emulsifying polymer, a polyvinyl alcohol having a saponification value of 92 to 98 mol %, and a crosslinking agent to the dispersion; and forming a coated layer by applying a coating solution prepared by in-line mixing of a water-soluble aluminum compound in the ink-receiving layer-forming solution, on a support.

Alternatively, the second method of producing an inkjet-recording medium according to the invention comprises preparing a dispersion by counter-colliding inorganic fine particles, a zirconium compound and a crosslinking agent, or by passing inorganic fine particles, a zirconium compound and a crosslinking agent through an orifice, by using a high-pressure dispersing machine; preparing an ink-receiving layer-forming solution by adding a cationic modified self-emulsifying polymer and a polyvinyl alcohol having a saponification value of 92 to 98 mol % to the dispersion; and forming a coated layer by applying a coating solution prepared by in-line mixing of a water-soluble aluminum compound in the ink-receiving layer-forming solution, on a support.

The inkjet-recording medium according to the invention may be produced by the first or second method of producing an inkjet-recording medium according to the invention.

The dispersion obtained by counter-colliding "inorganic fine particles and a zirconium compound" or "inorganic fine particles, a zirconium compound and a crosslinking agent", or by passing "inorganic fine particles and a zirconium compound" or "inorganic fine particles, a zirconium compound and a crosslinking agent" through an orifice, by using a high-pressure dispersing machine is advantageous in that it contains inorganic fine particles having a smaller particle diameter.

The mixture, "inorganic fine particles and zirconium compound" or "inorganic fine particles, zirconium compound and crosslinking agent", is fed into a high-pressure dispersing machine, as it is in the dispersed (roughly dispersed) state. Preliminary mixing (rough dispersion) may be performed by common propeller agitating, turbine agitating, homomixer agitating, or the like.

The high-pressure dispersing machine for use in dispersion is generally, favorably a commercially available apparatus called high-pressure homogenizer.

Typical examples of the high-pressure homogenizers include Nanomizer (trade name, manufactured by Nanomizer), Microfluidizer (trade name, manufactured by Microfluidex Inc.), Ultimizer (manufactured by Sugino Machine Ltd.), and the like.

The orifice is a mechanism of restricting flow of liquid fed through a straight pipe with a thin plate having fine circular holes (orifice plate) inserted therein.

The high-pressure homogenizer is an apparatus basically consisting of a high pressure-generating unit for pressurizing, for example, raw material slurry and a counter-collision or orifice unit. Generally, a high-pressure pump called plunger pump is used favorably in the high pressure-generating unit. Any one of various kinds of high-pressure pumps, single pump, double pumps, triple pumps, and others, may be used in the invention without restriction.

The pressure when particles are counter-collided at high pressure is preferably 50 MPa or more, more preferably 100 MPa or more, and still more preferably 130 MPa or more.

The pressure difference between the inlet and the outlet of orifice during processing is also preferably 50 MPa or more, more preferably 100 MPa or more, and still more preferably 130 MPa or more, similarly to the processing pressure above.

The collision speed during counter collision of preliminary dispersion is preferably 50 m/sec or more, more preferably 100 m/sec or more, and still more preferably 150 m/sec or more, as relative velocity.

The linear velocity of a solvent passing through the orifice may vary according to the pore size of the orifice used, but is preferably 50 m/sec or more, more preferably 100 m/sec or more, and still more preferably 150 m/sec or more, similarly to the collision speed during counter collision.

By any method, the dispersion efficiency depends on the processing pressure, and a higher processing pressure results in higher dispersion efficiency. However, a processing pressure of more than 350 MPa often causes problems in the pressure resistance of the piping of high-pressure pump and the durability of apparatus.

In any one of the methods described above, the frequency of processing is not particularly limited, and normally selected in the range of once to dozens of times. The dispersion is prepared in this manner.

Various additives may be added in preparation of the dispersion.

Examples of the additives include various nonionic or cationic surfactants (anionic surfactants are undesirable because of aggregation), antifoams, nonionic hydrophilic polymers (polyvinyl alcohol, polyvinyl pyrrolidone, polyethyleneoxide, polyacrylamide, various sugars, gelatin, pullulan, etc.), nonionic or cationic latex dispersions, water-miscible organic solvents (ethyl acetate, methanol, ethanol, isopropanol, n-propanol, acetone, etc.), inorganic salts, pH adjusters, and the like, and these additives are used as needed.

In particular, water-miscible organic solvents, which prevent microaggregation of inorganic fine particles (silica) during preliminary dispersion, are desirable. The water-miscible organic solvent is used in an amount of 0.1 to 20 wt %, particularly preferably 0.5 to 10 wt %, in the dispersion.

The pH during preparation of an inorganic fine particle (vapor-phase-process silica) dispersion may vary significantly, for example, according to the kinds of the inorganic fine particles (vapor-phase-process silica) used and the various additives added, but are generally 1 to 8, particularly preferably 2 to 7. Two or more additives may be used in combination in the dispersion.

In the method of producing an inkjet-recording medium according to the invention, an ink-receiving layer-forming solution is prepared by adding a cationic modified self-emulsifying polymer, a polyvinyl alcohol according to the invention, and the like to the dispersion obtained by the method described above. The dispersion described above, the cationic modified self-emulsifying polymer, the polyvinyl alcohol according to the invention, and others may be mixed, for example, by common propeller agitation, turbine agitation, or homomixer agitation.

In the method of producing an inkjet-recording medium according to the invention, examples of the in-line mixers favorably used in in-line mixing of the water-soluble aluminum compound in the ink-receiving layer-forming solution include, but are not limited to, those described in JP-A No. 2002-85948 and others.

The method of producing an inkjet-recording medium according to the invention may further comprise crosslinking and hardening the coated layer formed on a support by applying the coating solution obtained by in-line mixing of a water-soluble aluminum compound in the ink-receiving layer-forming solution, by applying thereon a basic solution having a pH of 7.1 or more, either (1) simultaneously with application of the coating solution, or (2) before the coated layer exhibits a falling drying rate during drying of the coated layer.

Presence of such a crosslinked hardened ink-receiving layer is preferable from the viewpoints of the ink-absorbing capacity and cracking resistance of the layer.

In the method of producing an inkjet-recording medium according to the invention, water, an organic solvent, or the mixed solvent thereof may be used as the solvent in each step. Examples of the organic solvents for use in coating include alcohols such as methanol, ethanol, n-propanol, i-propanol, and methoxypropanol, ketones such as acetone and methylethylketone, tetrahydrofuran, acetonitrile, ethyl acetate, toluene, and the like.

The coating solution of the ink receiving layer can be coated by a known method, such as using an extrusion die coater, an air doctor coater, a blade coater, a rod coater, a knife coater, a squeeze coater, a reverse roll coater, or a bar coater.

The basic solution having a pH of 7.1 or more is applied on the coated layer formed by application of the ink-receiving layer-forming solution, simultaneously with application of the ink-receiving layer-forming solution or before the coated layer exhibits a falling drying rate during drying of the coated layer. Thus, the hardened layer is formed favorably by applying the basic solution having a pH of 7.1 or more on the coated layer during it shows a constant drying rate after application of the ink-receiving layer-forming solution.

The basic solution having a pH of 7.1 or more may contain a crosslinking agent and others as needed. The basic solution having a pH of 7.1 or more accelerates crosslinking as an alkaline solution, and thus, the pH thereof is preferably 7.5 or more, particularly preferably 7.9 or more. A pH closer to the acidic side may result in insufficient crosslinking of the polyvinyl alcohol contained in the ink-receiving layer-forming solution by the crosslinking agent, causing problems such as bronzing, cracking of the ink-receiving layer, and others.

The basic solution having a pH of 7.1 or more is prepared, for example, by adding a metal compound (e.g., 1 to 5%) and a basic compound (e.g., 1 to 5%), and also p-toluenesulfonic acid (e.g., 0.5 to 3%) as needed, to ion-exchange water and agitating the mixture thoroughly. "%" above of each component means solid weight %.

The phrase "before the coated layer exhibits a falling drying rate" normally means a period of few minutes after application of the coating solution for the ink-receiving layer, during which the coated layer shows a phenomenon of "constant drying rate" wherein the content of the solvent (dispersion medium) therein decreases linearly over time. The period of this "constant drying rate" is described, for example, in Chemical Engineering Handbook (pp. 707 to 712, published by Maruzen Co., Ltd., Oct. 25, 1980).

The ink-receiving layer-forming solution is dried after application generally at 40 to 180° C. for 0.5 to 10 minutes (preferably for 0.5 to 5 minutes), until the coated layer shows a falling drying speed as described above. The drying period, of course, varies according to the amount coated, but is favorably in the range above.

The inorganic fine particles in the inkjet-recording medium according to the invention may be silica fine particles, and the silica fine particles may be particles of a vapor-phase-process silica having a BET specific surface area of 200 $m^2/g$ or more.

The polymerization degree of the polyvinyl alcohol used in the inkjet-recording medium according to the invention may be 1,500 to 3,600.

Also in the inkjet-recording medium according to the invention, the water-soluble aluminum compound may be a basic polyaluminum hydroxide compound. Also in the inkjet-recording medium according to the invention, the zirconium compound may be zirconyl acetate.

Also in the inkjet-recording medium according to the invention, the self-emulsifying polymer may be a cationic group containing urethane resin.

Also in the inkjet-recording medium according to the invention, the crosslinking agent may be boric acid or a borate salt.

The method of producing an inkjet-recording medium according to the invention may include additionally crosslinking and hardening the coated layer by applying thereon a basic solution having a pH of 7.1 or more, either (1) simultaneously with application of the coating solution, or (2) before the coated layer exhibits a falling drying rate during drying of the coated layer.

EXAMPLES

Hereinafter, the present invention will be described in more detail with reference to Examples, but it should be understood that the invention is not restricted by the following Examples. "Part" and "%" in the following Examples refer to parts by mass.

Example 1

"Preparation of Support"

50 parts of acacia LBKP and 50 parts of aspen LBKP were beaten to a Canadian freeness of 300 ml in a disk refiner, to give a pulp slurry.

Then, 1.3% of a cationic starch (CAT0304L, manufactured by Japan NSC), 0.15% of an anionic polyacrylamide (Polyacron ST-13, manufactured by Seiko Chemicals, Co., Ltd.), 0.29% of an alkylketene dimer (Sizepine K, manufactured by Arakawa Chemical Industries, Ltd.), 0.29% of epoxidated amide behenate, 0.32% of polyamide polyamine epichlorohydrin (Arafix 100, manufactured by Arakawa Chemical Industries, Ltd.) and then, 0.12% of an antifoaming agent with respect to the pulp were added to the pulp slurry obtained.

The above prepared pulp slurry is then made into paper using a Fourdrinier paper machine, and in a drying process the felt surface of the web is pressed against a drum dryer cylinder via a dryer canvas, with the dryer canvas tension adjusted to 1.6 kg/cm. After drying, the base paper is size pressed on both surfaces with polyvinyl alcohol (trade name: KL-118; manufactured by Kuraray Company Ltd.) coated at rate of 1 $g/m^2$, dried, and calender processed. The basis weight of the sheeted base paper was 157 $g/m^2$, and a base paper (base material) having a thickness of 157 μm was obtained.

After undertaking corona electrical discharge treatment of the wire surface (rear surface) of the base material, a blend of high- and low-density polyethylene resins at a ratio of 80%/20% was melt-extruded to a dry weight of 20 $g/m^2$ on the wire-faced surface (rear face) of the base material by using a melt extruder at a temperature of 320° C., to give a mat-surfaced thermoplastic layer (hereinafter, the thermoplastic resin face will be referred to as "rear face"). The thermoplastic resin layer on the rear face side was further treated with corona discharge, and then, a dispersion containing aluminum oxide ("Alumina Sol 100", manufactured by Nissan Chemical Industries Co., Ltd.) and silicon dioxide ("Snowtex O", manufactured by Nissan Chemical Industries Co., Ltd.) dispersed at a rate of 1:2 by weight as antistatic agents in water was coated thereon to a dry weight of 0.2 $g/m^2$. Then, the surface was corona-treated, and a polyethylene having a density of 0.93 $g/m^2$ containing 10 wt % titanium oxide was coated thereon to a dry weight of 24 $g/m^2$ at 320° C. by using a melt extruder.

<Preparation of Ink-Receiving Layer-Forming Solution A>

According to the following "silica dispersion A" composition, silica fine particles were added to a liquid containing dimethyldiallyl ammonium chloride polymer (Shallol DC902P, manufactured by Dai-Ichi Kogyo Seiyaku) in ion-exchange water; Zircosol ZA-30 manufactured by Daiichi Kigenso Kagaku Kogyo Co., Ltd. was added thereto; and the resulting slurry was dispersed in Ultimizer manufactured by Sugino Machine Ltd. at 170 MPa, to give a silica dispersion A containing particles having a median diameter (average particle diameter) of 120 nm.

According to the following composition of the ink-receiving layer-forming solution A, ion-exchange water, 7.5% boric acid solution, SC-505, polyvinyl alcohol solution, and SUPERFLEX 650-5 were added to the silica dispersion A in that order, to give an ink-receiving layer-forming solution A.

"Silica Dispersion A"

(1) Vapor-phase-process silica fine particles 15.0 parts
(AEROSIL 300SF75, manufactured by Nippon Aerosil Co., Ltd.)
(2) Ion-exchange water 82.9 parts
(3) "Shallol DC-902P" (51.5% solution) 1.31 parts
(dispersant, manufactured by Dai-ichi Kogyo Seiyaku Co., Ltd.)
(4) Zirconyl acetate "Zircosol ZA-30 (50% solution)" 0.81 part
(manufactured by Daiichi Kigenso Kagaku Kogyo Co., Ltd.)

"Composition of Ink-Receiving Layer-Forming Solution A"

(1) Silica dispersion A 59.5 parts
(2) Ion-exchange water 7.8 parts
(3) 7.5% Boric acid solution (crosslinking agent) 4.4 parts
(4) Dimethylamine epichlorohydrin polyalkylene polyamine polycondensate (50% solution) (SC-505, manufactured by Hymo Co., Ltd.) 0.1 part
(5) Following polyvinyl alcohol solution 26.0 parts
(6) Cationic modified polyurethane 2.2 parts
[SUPERFLEX 650-5 (25% solution))
(manufactured by Dai-ichi Kogyo Seiyaku Co., Ltd.)

<Composition of Polyvinyl Alcohol Solution>

(1) Polyvinyl alcohol 6.96 parts
("JM-23 (DLL" manufactured by Japan VAM & POVAL Co., Ltd., saponification value: 93.2 mol %, polymerization degree: 2,400)
(2) Polyoxyethylene lauryl ether 0.23 part
(surfactant, Emulgen 109P, manufactured by Kao Corp.)
(3) Diethylene glycol monobutylether 2.12 parts
(Butycenol 20P, manufactured by Kyowa Hakko Kogyo Co., Ltd.)
(4) Ion-exchange water 90.69 parts (Preparation of Inkjet-Recording Sheet)

The front face of the substrate above was corona-discharged; the ink-receiving layer-forming solution A and the following PAC 1 solution were in-line blended and coated thereon in coating amounts respectively of 183 g/m$^2$ and 11.4 g/m$^2$ by using an extrusion die coater. Then, the coated layer was dried in a hot air dryer at 80° C. (flow rate: 3 to 8 m/sec) to a solid matter concentration of 20%. The coated layer showed a constant drying rate during the period. The coated layer was then immersed in a basic solution (pH: 7.8) in the following composition for three seconds before it showed a falling drying rate, allowing deposition of the solution on the coated layer in an amount of 13 g/m$^2$, and dried at 65° C. for 10 minutes (hardening step), to give an inkjet-recording sheet of Example 1 carrying an ink-receiving layer having a dry film thickness of 32 μm.

<PAC 1 Solution>

(1) Aqueous polyaluminum chloride solution at a basicity of 83% (Alfine 83, manufactured by Taimei Chemicals Co., Ltd. Co.) 20 parts (2) Ion-exchange water 80 parts <Composition of Basic Solution>

(1) Boric acid 0.65 part (2) Zirconium ammonium carbonate (28% aqueous solution) 0.33 part (Zircosol AC-7, manufactured by Daiichi Kigenso Kagaku Kogyo Co., Ltd.)

(3) Ammonium carbonate (reagent grade) 3.5 parts (manufactured by Kanto Kagaku Co. Inc.)

(4) Ion-exchange water 63.3 parts (5) Polyoxyethylene lauryl ether (2% aqueous solution) 30.0 parts (surfactant, Emulgen 109P, manufactured by Kao Corp.)

Example 2

An inkjet-recording sheet of Example 2 was prepared in a similar manner to Example 1, except that the polyvinyl alcohol used in the ink-receiving layer-forming solution A was replaced with another polyvinyl alcohol (Denka POVAL H-24, manufactured by Denki Kagaku Kogyo K.K., saponification value; 95.6 mol %, polymerization degree: 2,400).

Example 3

An inkjet-recording sheet of Example 3 was prepared in a similar manner to Example 1, except that the polyvinyl alcohol used in the ink-receiving layer-forming solution A was replaced with another polyvinyl alcohol (JM23, manufactured by Japan VAM & POVAL Co., Ltd., saponification value: 96.8 mol %, polymerization degree: 2,400).

Example 4

An inkjet-recording sheet of Example 4 was prepared in a similar manner to Example 1, except that the polyvinyl alcohol used in the ink-receiving layer-forming solution A was replaced with another polyvinyl alcohol (JM-33, manufactured by Japan VAM & POVAL Co., Ltd., saponification value: 94.3 mol %, polymerization degree: 3,300) and the process of "Preparation of inkjet-recording sheet" mentioned in Example 1 was replaced with the following process of "Preparation of inkjet-recording sheet".

(Preparation of Inkjet-Recording Sheet)

The front face of a support was corona-discharged as in Example 1, and the ink-receiving layer-forming solution and the PAC 1 solution were in-line blended and coated thereon in coating amounts respectively of 183 g/m$^2$ and 11.4 g/m$^2$ by using an extrusion die coater. The support was then treated in a cold-air dryer at 5° C. and at a relative humidity of 30% (flow rate: 3 to 8 m/sec) for 5 minutes, and then, dried with dry air at 25° C. and a relative humidity of 25% (flow rate: 3 to 8 m/sec) for 20 minutes, to give an inkjet-recording sheet according to the invention carrying an ink-receiving layer having a dry film thickness of 30 μm.

Example 5

According to the following "silica dispersion B" composition, a slurry containing ion-exchange water, boric acid, dimethyldiallylammonium chloride polymer (Shallol DC902P, manufactured by Dai-Ichi Kogyo Seiyaku), silica fine particles, and Zircosol ZA-30 manufactured by Daiichi Kigenso Kagaku Kogyo Co., Ltd. was dispersed in Ultimizer manufactured by Sugino Machine Ltd. once at 170 MPa, to give a silica dispersion B containing particles having a median diameter (average particle diameter) of 120 nm.

According to the following composition for the ink-receiving layer-forming solution B, ion-exchange water, SC-505, polyvinyl alcohol solution, and SUPERFLEX 650-5 were added to and mixed with the silica dispersion B, to give an ink-receiving layer-forming solution B. An inkjet-recording sheet of Example 5 was prepared in a similar manner to Example 1, except that the ink-receiving layer-forming solution B was used.

"Silica Dispersion B"

(1) Vapor-phase-process silica fine particles 15.0 parts (AEROSIL 300SF75, Nippon Aerosil Co., Ltd.)

(2) Ion-exchange water 82.32 parts (3) "Shallol DC-902P" (51.5% solution) 1.31 parts (dispersant, manufactured by Dai-ichi Kogyo Seiyaku Co., Ltd.)

(4) Zirconyl acetate "Zircosol ZA-30 (50% solution)" 0.81 part (manufactured by Daiichi Kigenso Kagaku Kogyo Co., Ltd.)

(5) Boric acid 0.56 part

"Composition of Ink-Receiving Layer-Forming Solution B"

(1) Silica dispersion B 59.5 parts (2) Ion-exchange water 12.2 parts (3) Dimethylamine-epichlorohydrin-polyalkylene polyamine polycondensate (50% solution)

(SC-505, manufactured by Hymo Co., Ltd.) 0.1 part (4) Following polyvinyl alcohol solution 26.0 parts (5) Cationic modified polyurethane 2.2 parts (SUPERFLEX 650-5 (25% solution))

(manufactured by Dai-ichi Kogyo Seiyaku Co., Ltd.)

<Composition of Polyvinyl Alcohol Solution>

(1) polyvinyl alcohol 6.96 parts ("Denka POVAL H-24", manufactured by Denki Kagaku Kogyo K.K, saponification value: 95.6 mol %, polymerization degree: 2,400)

(2) Polyoxyethylene laurylether 0.23 part (surfactant, Emulgen 109P, manufactured by Kao Corp.)

(3) Diethylene glycol monobutylether 2.12 parts (Butycenol 20P, manufactured by Kyowa Hakko Kogyo Co., Ltd.)

(4) Ion-exchange water 90.69 parts

Example 6

A slurry containing ion-exchange water, 7.5% boric acid solution, dimethyl diallylammonium chloride polymer (Shallol DC902P, manufactured by Dai-Ichi Kogyo Seiyaku), silica fine particles, and Zircosol ZA-30 manufactured by Daiichi Kigenso Kagaku Kogyo Co., Ltd. prepared according to the following composition for the "silica dispersion C" was dispersed in Ultimizer manufactured by Sugino Machine Ltd. at 170 MPa, to give a silica dispersion C containing particles having a median diameter (average particle diameter) of 120 nm.

Ion-exchange water, 7.5% boric acid solution, SC-505, polyvinyl alcohol solution, and SUPERFLEX 650-5 were then added to the silica dispersion C according to the following composition for the ink-receiving layer-forming solution C, to give an ink-receiving layer-forming solution C.

"Silica Dispersion C"

(1) Vapor-phase-process silica fine particles 15.0 parts (AEROSIL 300SF75, manufactured by Nippon Aerosil Co., Ltd.)

(2) Ion-exchange water 78.5 parts (3) 7.5% Boric acid solution (crosslinking agent) 4.4 parts (4) "Shallol DC-902P" (51.5% solution) 1.31 parts (dispersant, manufactured by Dai-ichi Kogyo Seiyaku Co., Ltd.)

(5) Zirconyl acetate "Zircosol ZA-30 (50% solution)" 0.81 part (manufactured by Daiichi Kigenso Kagaku Kogyo Co., Ltd.)

"Composition of Ink-Receiving Layer-Forming Solution C"

(1) Silica dispersion C 59.5 parts (2) Ion-exchange water 12.2 parts (3) Dimethylamine-epichlorohydrin-polyalkylene polyamine polycondensate (50% solution)

(SC-505, manufactured by Hymo Co., Ltd.) 0.1 part (4) Following polyvinyl alcohol solution 26.0 parts (5) Cationic modified polyurethane 2.2 parts (SUPERFLEX 650-5 (25% solution))

(manufactured by Dai-ichi Kogyo Seiyaku Co., Ltd.)

<Composition of Polyvinyl Alcohol Solution>

(1) Polyvinyl alcohol 6.96 parts (JM-33, manufactured by Japan VAM & POVAL Co., Ltd., saponification value: 94.3 mol %, polymerization degree: 3,300)

(2) Polyoxyethylene lauryl ether 0.23 part (surfactant, Emulgen 109P, manufactured by Kao Corp.)

(3) Diethylene glycol monobutylether 2.12 parts (Butycenol 20P, manufactured by Kyowa Hakko Kogyo Co., Ltd.)

(4) Ion-exchange water 90.69 parts (Preparation of Inkjet-Recording Sheet)

The front face of a support is corona-discharged, and the ink-receiving layer-forming solution C and the following PAC 1 solution were in-line blended and coated thereon in coating amounts respectively of 183 g/m$^2$ and 11.4 g/m$^2$ by using an extrusion die coater. The support was then dried in a hot air dryer at 80° C. (flow rate: 3 to 8 m/sec) until the coated layer has a solid matter concentration of 20%. The coated layer showed a constant drying rate during the period. The coated layer was immersed in a basic solution (pH: 7.8) in the following composition for three seconds before it showed a falling drying rate, allowing deposition of the solution on the coated layer in an amount of 13 g/m$^2$, and dried at 65° C. for 10 minutes (hardening step), to give an inkjet-recording sheet of Example 6 carrying an ink-receiving layer having a dry film thickness of 32 μm.

<PAC 1 Solution>

(2) Aqueous polyaluminum chloride solution at a basicity of 83% (Alfine 83, manufactured by Taimei Chemicals Co., Ltd.) 20 parts (2) Ion-exchange water 80 parts <Composition of Basic Solution>

(1) Boric acid 0.65 part (2) Zirconium ammonium carbonate (28% aqueous solution) 0.33 part (Zircosol AC-7, manufactured by Daiichi Kigenso Kagaku Kogyo Co., Ltd.)

(3) Ammonium carbonate (reagent grade) 3.5 parts (manufactured by Kanto Kagaku Co. Inc.)

(4) Ion-exchange water 63.3 parts (5) Polyoxyethylene laurylether (2% aqueous solution) 30.0 parts (surfactant, Emulgen 109P, manufactured by Kao Corp.)

Comparative Example 1

A slurry containing ion-exchange water, dimethyl diallylammonium chloride polymer (Shallol DC902P, manufactured by Dai-Ichi Kogyo Seiyaku), silica fine particles, and Zircosol ZA-30 manufactured by Daiichi Kigenso Kagaku Kogyo Co., Ltd. prepared according to the following composition for the "silica dispersion solution C" was dispersed in a sand grinder ("DYNO-MILL TYPE:KDL-PILT", manufactured by Shinmaru Enterprises Corp.) containing zirconium oxide ($ZrO_2$) beads having an average particle diameter of 0.65 mm in an amount of 80 vol %, to give a fine dispersion containing particles having a median diameter (average particle diameter) of 140 nm.

Ion-exchange water, 7.5% boric acid solution, SC-505, polyvinyl alcohol solution, and SUPERFLEX 650-5 were added in that order to the silica dispersion C according to the following composition for the ink-receiving layer-forming solution C, and the mixture was agitated, to give an ink-receiving layer-forming solution C.

"Silica Dispersion C"

(1) Vapor-phase-process silica fine particles 15.0 parts (AEROSIL 300SF75, manufactured by Nippon Aerosil Co., Ltd.)

(2) Ion-exchange water 82.9 parts (3) "Shallol DC-902P" (51.5% aqueous solution) 1.31 parts (Dispersant, manufactured by Dai-ichi Kogyo Seiyaku Co., Ltd.)

(4) "Zircosol ZA-30" (zirconyl acetate) 0.81 part (manufactured by Daiichi Kigenso Kagaku Kogyo Co., Ltd.)

"Composition of Ink-Receiving Layer-Forming Solution C"

(1) Silica dispersion C 59.5 parts (2) Ion-exchange water 7.8 parts (3) 7.5% Boric acid solution (crosslinking agent) 4.4 parts (4) Dimethylamine-epichlorohydrin-polyalkylene polyamine polycondensate (50% aqueous solution)

(SC-505, manufactured by Hymo Co., Ltd. Co., Ltd.) 0.2 part (5) Following polyvinyl alcohol solution 26.0 parts (6) Cationic modified polyurethane 2.2 parts (SUPERFLEX 650-5 (25% solution))

(manufactured by Dai-ichi Kogyo Seiyaku Co., Ltd.)

<Composition of Polyvinyl Alcohol Solution>

(1) Polyvinyl alcohol 6.96 parts ("PVA-224", manufactured by Kuraray, saponification value: 88.0 mol %, polymerization degree: 2,400)

(2) Polyoxyethylene laurylether 0.23 part
(surfactant Emulgen 109P, manufactured by Kao Corp.)
(3) Diethylene glycol monobutylether 2.12 parts
(Butycenol 20P, manufactured by Kyowa Hakko Kogyo Co., Ltd.)
(4) Ion-exchange water 90.69 parts
(Preparation of Inkjet-Recording Sheet)

The front face of a support was corona-discharged as in Example 1, and the ink-receiving layer-forming solution and the PAC 1 solution were in-line blended and coated thereon in coating amounts respectively of 183 g/m$^2$ and 11.4 g/m$^2$ by using an extrusion die coater. The support was then dried in a hot air dryer at 80° C. (flow rate: 3 to 8 m/sec) until the coated layer has a solid matter concentration of 20%. The coated layer showed a constant drying rate during the period. The coated layer was immersed in a basic solution (pH: 7.8) in the above composition for three seconds before it showed a falling drying rate, allowing deposition of the solution on the coated layer in an amount of 13 g/m$^2$, and dried at 65° C. for 10 minutes (hardening step), to give an inkjet-recording sheet of Comparative Example 1 carrying an ink-receiving layer having a dry film thickness of 32 μm.

Comparative Example 2

An inkjet-recording sheet of Comparative Example 2 was prepared in a similar manner to Comparative Example 1, except that the polyvinyl alcohol used in the ink-receiving layer-forming solution C was replaced with "PVA-235, manufactured by Kuraray" having a saponification value of 88.0 mol % and a polymerization degree of 3,500.

Comparative Example 3

An inkjet-recording sheet of Comparative Example 3 was prepared in a similar manner to Comparative Example 1, except that the polyvinyl alcohol used in the ink-receiving layer-forming solution C was replaced with "JC-25" manufactured by Japan VAM & POVAL Co., Ltd. having a saponification value of 99.1 mol % and a polymerization degree of 2,400.

The sheet obtained in Comparative Example 3 was lower in ink-absorbing efficiency, and did not give an inkjet-recording sheet possibly evaluated as described below.

Comparative Example 4

An inkjet-recording sheet of Comparative Example 4 was prepared in a similar manner to Example 1, except that Zircosol ZA-30 as zirconyl acetate was not added.

Comparative Example 5

An inkjet-recording sheet of Comparative Example 5 was prepared in a similar manner to Example 1, except that the PAC 1 solution was not in-line blend.

Comparative Example 6

An inkjet-recording sheet of Comparative Example 6 was prepared in a similar manner to Example 1, except that the cationic modified polyurethane (SUPERFLEX 650-5 (25% solution)) was not added.

The ink-receiving layer-forming solutions and ink-jet recording media thus obtained were evaluated in the following tests. The results are summarized in Table 1.

"Viscosity Measurement"

The viscosity of the ink-receiving layer-forming solution was determined by using Rheo Stress 600 manufactured by HAAKE at a test temperature of 30° C. and a shear rate of $10^{-2}$ sec$^{-1}$.

"Printing Density"

An image was printed on each inkjet-recording sheet with black ink in an inkjet printer "PM-G800" manufactured by Seiko Epson Corporation and an inkjet printer "PIXUS iP8600" manufactured by Canon Inc. The optical density of the printed sample was determined by using X-Lite.

"Hue of Halftone Gray Area"

A gray color is generated by using Adobe Photoshop, using blue, green, and red colors at grades of 128, and the gray image is printed on each inkjet-recording sheet in an inkjet printer "PM-G800" manufactured by Seiko Epson Corporation, and inkjet printer "PIXUS iP8600" manufactured by Canon Inc.

After printing, the samples was dried under a condition of 23° C. and 60% RH for 24 hours, and D50 and hue at a view angle of two degrees (L, a* value, and b* value) were determined by using "SPECTORPHOTOMETER CM-7300d" manufactured by Konica Minolta. a* value and b* value closer to 0 indicate a color closer to neutral gray and are thus favorable.

"Ink-Absorbing Efficiency"

A black painted image was formed on paper under a condition of 30° C. and 80% RH by using an inkjet printer "PM-G800" manufactured by Seiko Epson Corporation; a plain paper is placed and pressed slightly on the printed paper immediately after printing; and the degree of the ink transferred onto the plain paper was analyzed by visual observation and evaluated according to the following criteria:

A: No transfer.
B: Some transfer.
C: Significant transfer.

"Stability of the Viscosity of Ink-Receiving Layer-Forming Solution"

Viscosity change of the ink-receiving layer-forming solution during storage at 30° C. for 4 days was evaluated.

A: Less than twice higher than the viscosity immediately after preparation
B: 2.1 to 5 times higher than the viscosity immediately after preparation
C: 5.1 times or more higher than the viscosity immediately after preparation

TABLE 1

| | Example 1 | Example 2 | Example 3 | Example 4 | Example 5 | Example 6 | Comparative Example 1 | Comparative Example 2 | Comparative Example 3 | Comparative Example 4 | Comparative Example 5 | Comparative Example 6 |
|---|---|---|---|---|---|---|---|---|---|---|---|---|
| Polyvinyl alcohol saponification value (mol %) | 93.2 | 95.6 | 96.8 | 94.3 | 95.6 | 94.3 | 88.0 | 88.0 | 99.1 | 93.2 | 93.2 | 93.2 |
| Polyvinyl alcohol polymerization degree | 2400 | 2400 | 2400 | 3300 | 2400 | 3300 | 2400 | 3500 | 2400 | 2400 | 2400 | 2400 |

TABLE 1-continued

| | | Example 1 | Example 2 | Example 3 | Example 4 | Example 5 | Example 6 | Comparative Example 1 | Comparative Example 2 | Comparative Example 3 | Comparative Example 4 | Comparative Example 5 | Comparative Example 6 |
|---|---|---|---|---|---|---|---|---|---|---|---|---|---|
| Viscosity of ink-receiving layer-forming solution (mPa · s) | | 62 | 57 | 55 | 102 | 49 | 110 | 500 | 800 | 50 | 80 | 55 | 60 |
| Stability | | A | A | A | A | A | A | C | C | A | B | A | A |
| Printing density (PM-G800) | | 2.20 | 2.23 | 2.22 | 2.25 | 2.26 | 2.23 | 2.21 | 2.20 | — | 2.22 | 2.20 | 2.21 |
| Printing density (iP8600) | | 2.43 | 2.44 | 2.42 | 2.44 | 2.43 | 2.43 | 2.42 | 2.40 | — | 2.42 | 2.40 | 2.41 |
| Hue in gray area (PM-G800) | L | 62.6 | 63.5 | 63.5 | 62.9 | 62.8 | 62.6 | 62.5 | 62.90 | — | 62.5 | 62.7 | 62.9 |
| | a* | 1.6 | 1.4 | 1.3 | 1.5 | 1.4 | 1.4 | 2.7 | 2.8 | — | 2.9 | 2.8 | 2.5 |
| | b* | −8.2 | −7.8 | −7.4 | −7.5 | −7.6 | −7.6 | −9.2 | −9.3 | — | −10.2 | −9.3 | −10.5 |
| Hue in gray area (PIXUS iP8600) | L | 60.2 | 60.0 | 59.9 | 59.5 | 59.6 | 59.4 | 59.5 | 59.5 | — | 59.0 | 59.4 | 58.2 |
| | a* | −1.7 | −1.6 | −1.5 | −1.1 | −1.2 | −1.2 | −1.5 | −1.6 | — | −2.1 | −1.7 | 2.3 |
| | b* | −6.2 | −5.8 | −5.3 | −5.3 | −5.2 | −5.1 | −7.2 | −7.3 | — | −8.6 | −7.4 | −8.7 |
| Ink-absorbing efficiency | | A | A | A | A | A | A | B | B | C | A | A | A |

As apparent from Table 1, the present invention provides inkjet-recording media prepared from a coating solution stabilized in viscosity that allow printing at high density, gives a favorable gray printed image, and has a favorable ink-absorbing efficiency.

What is claimed is:

1. A method of producing an inkjet-recording medium, comprising:

preparing a dispersion from inorganic fine particles having a particle diameter of 20 nm or less and a zirconium compound by subjecting the inorganic fine particles and the zirconium compound to counter-collision, or by passing the inorganic fine particles and the zirconium compound through an orifice, using a high-pressure dispersing machine of which processing pressure is 50 MPa or more;

preparing an ink-receiving layer-forming solution by adding a cationic modified self-emulsifying polymer, a polyvinyl alcohol having a saponification value of 92 to 98 mol %, and a crosslinking agent to the dispersion; and forming a coated layer by applying a coating solution prepared by in-line mixing of a water-soluble aluminum compound in the ink-receiving layer-forming solution, on a support.

2. The method of producing an inkjet-recording medium of claim 1, further comprising crosslinking and hardening the coated layer by applying thereon a basic solution having a pH of 7.1 or more, either (1) simultaneously with application of the coating solution, or (2) before the coated layer exhibits a falling drying rate during drying of the coated layer.

3. The method of claim 1, wherein the inorganic fine particles and the zirconium compound are subjected to a preliminary dispersion prior to subjecting them to counter-collision or passing though an orifice.

4. A method of producing an inkjet-recording medium, comprising:

preparing a dispersion from inorganic fine particles having a particle diameter of 20 nm or less and a zirconium compound by subjecting the inorganic fine particles and the zirconium compound to counter-collision, or by passing the inorganic fine particles and the zirconium compound through an orifice, using a high-pressure dispersing machine of which processing pressure is 50 MPa or more;

preparing an ink-receiving layer-forming solution by adding a cationic modified self-emulsifying polymer and a polyvinyl alcohol having a saponification value of 92 to 98 mol % to the dispersion; and forming a coated layer by applying a coating solution prepared by in-line mixing of a water-soluble aluminum compound in the ink-receiving layer-forming solution, on a support.

5. The method of producing an inkjet-recording medium of claim 4, further comprising crosslinking and hardening the coated layer by applying thereon a basic solution having a pH of 7.1 or more, either (1) simultaneously with application of the coating solution, or (2) before the coated layer exhibits a falling drying rate during drying of the coated layer.

* * * * *